United States Patent [19]

Paris et al.

[11] Patent Number: 4,609,193

[45] Date of Patent: Sep. 2, 1986

[54] BACK AND GLUTEUS MAXIMUS EXERCISER

[75] Inventors: Win S. Paris, 28 Sea Cove Dr., Rancho Palos Verdes, Calif. 90274; Russell Knipp, Santa Ana, Calif.

[73] Assignee: Winn S. Paris, Torrance, Calif.

[21] Appl. No.: 544,353

[22] Filed: Oct. 21, 1983

[51] Int. Cl.[4] ..... A63B 00/00

[52] U.S. Cl. ..... 272/145

[58] Field of Search ..... 272/144, 145, 109, 93; 128/75, 68

[56] References Cited

U.S. PATENT DOCUMENTS

| | | | |
|---|---|---|---|
| D. 224,422 | 7/1972 | Beach | 272/144 |
| 1,693,810 | 12/1928 | Daniels et al. | 272/144 |
| 2,283,475 | 5/1942 | Wagner | 128/24 R |
| 2,932,038 | 4/1960 | Sprague | 128/24 R |
| 3,685,511 | 10/1972 | Alvarez | 128/75 |
| 4,292,962 | 10/1981 | Krause | 272/145 |
| 4,410,176 | 10/1983 | Miller | 297/326 |
| 4,461,287 | 7/1984 | Takahashi | 272/145 |

OTHER PUBLICATIONS

*Universal,* equipment catalogue of 1982–1983, pp. 12 & 13.

*Primary Examiner*—Richard J. Apley
*Assistant Examiner*—James Prizant
*Attorney, Agent, or Firm*—Pretty, Schroeder, Brueggemann & Clark

[57] ABSTRACT

An exercise device is providing for suspending the body above a support surface while a person performs exercises designed to stretch and strengthen the full range of back extensor, abdominal and gluteus maximus muscles. The device includes a pelvic brace which cooperates with a rotatable leg restraining member to position the body, in a cantilevered fashion, above the support surface nearly horizontally and face down preparatory to exercising the back extensor and abdominal muscles. Alternatively, the device can be mounted differently to strengthen and tone the gluteus maximus muscles. Utilizing gravity traction, the exercise device tends to decompress the spinal column while the exercises are being performed.

12 Claims, 7 Drawing Figures

BACK AND GLUTEUS MAXIMUS EXERCISER

FIELD OF THE INVENTION

The present invention relates to muscle toning exercise devices and, more particularly, to a portable exercise device.

BACKGROUND OF THE INVENTION

The spine is composed of separate but interlocking vertebrae which work like building blocks, one stacked upon another, to provide support for the body. Without proper muscular support, these blocks become unstable. Between these vertebrae are shock absorbing pads called disks which keep the space between the vertebrae open enough to insure that the nerves and the blood vessels can pass between them without injury. If the muscles adjacent the spine become too tight or the disks flatten out, decreased circulation or nerve function interference can result.

The disks flatten over a period of time principally because the weight of the head, neck and shoulders, and because the gravitational stress of an active lifestyle constantly compress the spine throughout our lives. Additionally, over eating which generally results in weak abdominal muscles, poor posture and lack of exercise all contribute to weaken the muscular support for the vertebrae and can make a person more susceptible to back sprains or more serious injury. In this light, it is well known that such problems can either be lessened, avoided or cured through decompression of the vertebrae and an exercise program designed at strengthening the back extensor and abdominal muscles.

A strong, healthy body often helps an individual to sleep more soundly, increase his or her productivity, and avoid unnecessary injuries. Besides helping an individual to feel good, a proper diet and a rigorous exercise program can help a person look good and enhance his or her self-image. The importance of this is illustrated by today's fashions which increasingly call for strong and firm abdominal and gluteus maximus muscles. These factors have created a need for devices and methods designed to promote good health, by decompressing the spine and strengthening the supporting muscles, and good looks also by strenghtening and toning the abdominal and gluteus maximus muscles.

Several devices have been devised which attempt to decompress the spine via controlled traction in the cervical and/or lumbar spine areas. Some of these devices effect this decompression by suspending the body from the heels in an up-side-down manner. Problems with such devices, however, include the possibility of serious trauma to the feet, ankle, knee and hip joints which can result from the suspension of the body from the ankles. Additionally, these devices have proven to be less than entirely satisfactory at strengthening the back extensor muscles and toning the gluteus maximus muscles.

Other spinal decompression/gravity traction exercise devices are used to suspend the body above a support surface by the thighs, pelvis or abdomen. Some of these devices are designed principally to support the user in an inverted position for spinal decompression and the exercises performable on such devices are merely an incident of the inverted supported position. Other such devices, which typically rotate to a limited extent to facilitate inversion of the body, are specifically designed so that exercising can be done while simultaneously decompressing the spinal column. However, the positioning of the body on these latter devices and their present state of design make it very difficult to fully exercise the back extensor, the abdominal, and the gluteus maximus muscles.

Accordingly, there is a need for a fully collapsible and portable exercise device which is principally constructed for stretching, strengthening and toning the back extensor, the abdominal, and the gluteus maximus muscles while simultaneously decompressing the spinal column. Such a device should include a stable support frame capable of suspending a body above a ground-support surface and withstanding the torque exerted by rigorous exercise on the device. Safety features designed to prevent the unintended repositioning of device components during exercising should be included as well. The present invention fulfills these needs and provides other related advantages.

SUMMARY OF THE INVENTION

The present invention resides in a lightweight, portable exercise device, wherein a collapsible frame holds several body-support components above a horizontal support surface. These body-support components underprop and suspend a person above the support surface while the person performs exercises designed to stretch and strengthen the full range of back extensor muscles, the abdominal muscles and the gluteus maximus muscles. Additionally, the device supports the body in a manner which tends to decompress the spinal column while the exercises are being performed.

In one preferred form, a collapsible tubular frame, comprising two U-shaped frame legs, engages the support surface along two substantially parallel lines and the frame legs are spaced sufficiently to prevent any torque forces exerted by the person on the device, while exercising, from toppling it. The frame legs can be connected at two upper rotatable connections to one another and the frame legs are locked in their spaced relation during use by several locking members.

A pelvic brace lying substantially in a horizontal plane between the upper rotatable connections of the frame can underprop the anterior pelvic area of a body to hold the body above the support surface. This pelvic brace may be connected to a leg restraining member which rotates generally about a line extending from one upper rotatable connection to another. The leg restraining member can be positioned with respect to the pelvic brace to provide a generally downwardly directed force to the backs of a user's legs after the user has mounted the exercise device to perform back extensor and abdominal muscle stretching and strengthening exercises. Once the leg restraining member has been correctly positioned, it can be locked into place by a locking mechanism to prevent the unintended rotation of the leg restraining member which could result in injury to the user.

After the exercise device has been properly set up, the user can mount the device by positioning the anterior pelvic area of the body so that it is in contact wih the pelvic brace. The user then leans over the pelvic brace while keeping the body straight and lifting his or her feet off the support surface. The straight body is rotated over the pelvic brace until the backs of the legs contact the leg restraining member at which time the person is suspended above the support surface nearly horizontally and face down.

With the body so cantilevered by the exercise device, the user can utilize gravity traction advantageously to decompress the spinal column while simultaneously stretching and strengthening substantially all of the back extensor muscles. Additionally, inverted sit-ups can be performed from this position to strengthen and tone the abdominal muscles.

To strengthen and tone the gluteus maximus muscles, the user can alternatively mount the exercise device by first facing the leg restraining member and positioning the body next to the pelvic brace on the side of the device opposite the leg restraining member. Bending at the waist, the user then leans over the pelvic brace and grasps both sides of one of the U-shaped frame legs. When so positioned, the user holds the torso portion of the body stationary, with respect to the device, and then moves his or her legs in any combination of vertical, horizontal and rotational directions. Important benefits derived from exercising the gluteus maximus muscles as described include spinal column decompression while the user is so mounted and very rapid strengthening and toning of the muscles resulting from regular use of the device in this fashion.

The exercise device can be conventiently collapsed or folded by unlocking the frame legs and the leg restraining member and then moving the frame legs and the leg restraining member until all of the components of the exercise device are in substantially planar alignment. This collapsibility feature eases transportation problems and facilitates convenient storage of the device when it is not in use.

Other features and advantages of the present invention will become apparent from the following detailed description, taken in conjunction with the accompanying drawings, which illustrate, by way of example, the principals of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
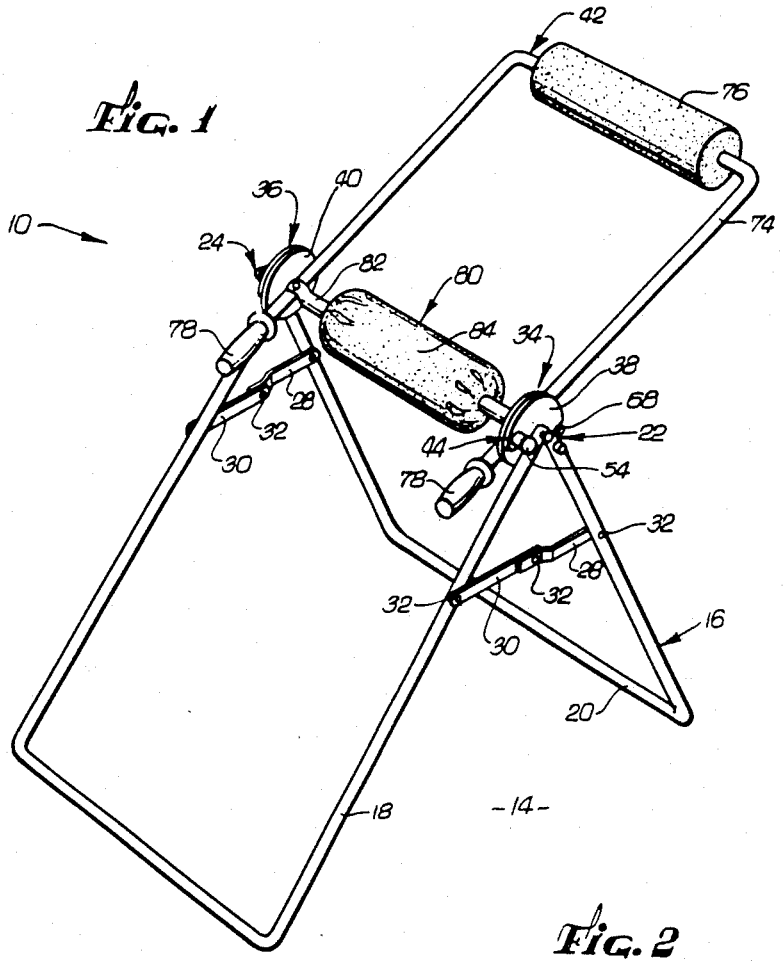
FIG. 1 is a perspective view of an exercise device embodying the present invention.

As is shown in the drawings for purposes of illustration, the present invention is concerned with a back and gluteus maximus exercise device, generally designated by the reference number 10, which is designed to support the body of a user 12 above a horizontal support surface 14. The body 12 can be mounted on the exercise device 10 to be held in a generally cantilevered position so that when the body is straightened, it is suspended nearly horizontally and face down preparatory to a series of exercises designed to stretch and strengthen the back extensor and abdominal muscles while simultaneously promoting spinal column decompression. Alternatively, the exercise device 10 can be mounted differently to perform a series of exercises designed to strengthen and tone the gluteus maximus muscles while also simultaneously promoting spinal column decompression.

In accordance with the present invention, a frame 16, including a pair of U-shaped frame support legs 18 and 20, engages the support surface 14 and holds all the other components of the exercise device 10 above the support surface (FIG. 1). The frame support legs 18 and 20 are connected to one another at two upper rotatable connections 22 and 24, defined generally by two nut and bolt combinations 26, and the frame support legs engage the support surface 14 along two generally parallel lines. During use, the frame support legs 18 and 20 are spaced sufficiently by a pair of locking bars 28 and 30 so that the exercise device 10 will not topple due to torque forces exerted by the body 12 while exercising on the exercise device.

The locking bars 28 and 30 are rotatably connected to the frame support legs 18 and 20 respectively, and to one another, at several rivet connections 32. When the locking bars 28 and 30 are extended to be in horizontal, end-to-end alignment, they form a rigid beam between the frame support legs 18 and 20 thereby rigidly holding and preventing any further rotation of the frame support legs about their upper rotatable connections 22 and 24. To collapse or fold the frame 16, the locking bars 28 and 30 are caused to rotate about the rivet connections 32 while simultaneously drawing the frame support legs 18 and 20 toward one another. This simple feature greatly enhances the portability and facilitates storage of the exercise device 10 when not in use.

Figure 2:
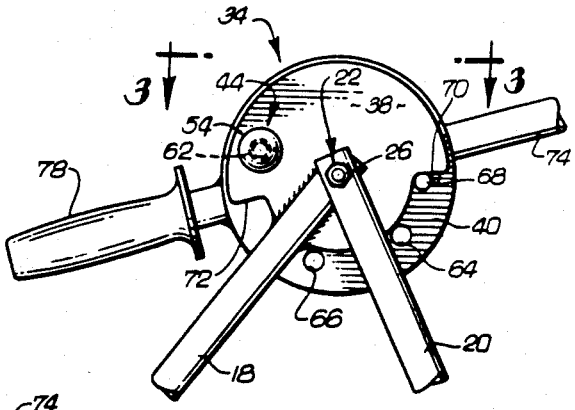
FIG. 2 is a fragmentary elevational view of the exercise device of FIG. 1, illustrating the positioning and alignment of a pair of frame legs and a leg restraining member with respect to and upper rotatable connection.
Figure 3:
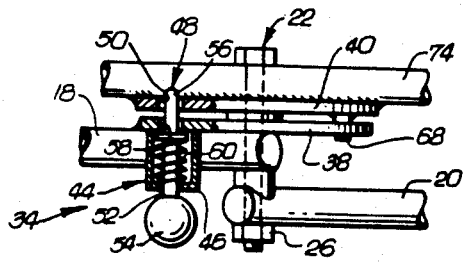
FIG. 3 is a fragmentary plan view taken generally along the line 3—3 of FIG. 2, partially broken away to illustrate a locking mechanism.

As illustrated in FIGS. 2 and 3, adjacent and coaxially mounted with the upper rotatable connections 22 and 24 are two rotation and lock assemblies 34 and 36, respectively. These rotation and lock assemblies 34 and 36 generally include an outer stop plate 38, which is rigidly connected to the frame support leg 18, and an inner rotation plate 40, which supports and is rigidly connected to a leg restraining member 42 which will be more fully described hereinafter. The nut and bolt combinations 26 hold the rotation and lock assemblies 34 and 36 adjacent the upper rotatable connections 22 and 24 in a manner allowing all of the exercise device 10 components to rotate thereabout.

The outer stop plate 38 lies generally in a vertical plane and provides support for a locking mechanism 44. This locking mechanism 44 comprises an outer housing 46, attached to and extending from the outer surface of the stop plate 38, for positioning a stop shaft 48 through an aperture 50 in the stop plate. The stop shaft 48 is essentially a cylindrical rod having a smaller diameter outer portion 52 capped by a ball 54, and a larger diameter inner portion 56 which extends through the aperture 50 in the stop plate 38.

A washer 58 rests upon the step between the two portions 52 and 56 of the stop shaft 48 for buttressing one end of a spring 60 held within the housing 46. This spring 60 is situated within the housing 46 generally over the smaller diameter outer portion 52 of the stop shaft 48 in a manner causing the larger diameter inner portion 56 to extend through the aperture 50 in the stop plate 38 its maximum extent during a normal rest state. The spring 60 requires that the user of the exercise device 10 positively grasp the ball 54 and use it as a handle to pull it away from the stop plate 38 to withdraw the larger diameter portion 56 of the stop shaft 48 into the housing 46.

Figure 5:
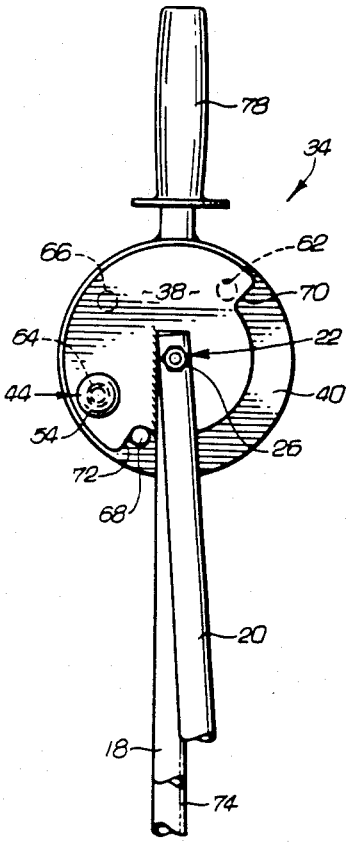
FIG. 5 is a fragmentary elevational view of the exercise device of FIG. 4, illustrating the positioning and alignment of the various components of the device when it is folded or collapsed.

Situated in a plane adjacent and parallel to the outer stop plate 38, the inner rotation plate 40 typically includes three apertures designed to accept the stop shaft 48 of the locking mechanism 44 for the purpose of rigidly holding the rotation plate, and thereby holding the leg restraining member 42 in three predetermined positions. As illustrated in FIG. 2, one of these apertures 62 is positioned upon the rotation plate 40 to position the leg restraining member 42 at an acute angle from the horizontal plane. As illustrated in FIG. 5, another aperture 64 is positioned to lock the leg restraining member 42 in a collapsed position generally aligned with the frame support legs 18 and 20 when folded together. The third or "mounting" aperture 66 is provided simply for positioning the leg restraining member 42 in a position which facilitates the convenient mounting of the exercise device 10 preparatory to exercising.

When the user desires to move the leg restraining member 42 into any of the aforementioned positions, all that is required is that the user grasp the ball 54 of the locking mechanism 44 and pull the ball against the force of the spring 60 until the stop shaft 48 is withdrawn from whichever aperture it may be extending through. The leg restraining member 42 is moved, thereby causing the attached rotation plate 40 to similarly move, until the desired aperture is aligned with the stop shaft 48. The user then releases the ball 54 to allow the spring 60 to force the stop shaft 48 through the selected aperture and rigidly hold and prevent any further angular displacement of the rotation plate 40 or the attached leg restraining member 42.

A limit stub 68 interacts with the stop plate 38 to effectively prevent the rotation plate 40 from moving more than 180 degrees. This is accomplished by rigidly attaching the limit stub 68 to the outer face of the inner rotation plate 40 toward the outer edge thereof, and by providing two abutment surfaces 70 and 72 for the stub on the stop plate 38. This limit stub 68 essentially provides a back-up safety mechanism for the remote possibility that the locking mechanism 44 would fail to hold the rotation plate 40 stationary while the exercise device 10 was being used to stretch and strengthen the back extensor or abdominal muscles. As a back-up safety mechanism, the limit stub 68 would prevent the leg restraining member 42 from moving significantly upwardly in the event of a locking mechanism failure; an event which could result in injury to the user.

The leg restraining member 42 is essentially a U-shaped tubular member 74 having a cylindrical pad 76 positioned at the base of the "U". Each side of the U-shaped tubular member 74 is attached to one of the rotation plates 40 so that the ends of the U-shaped tubular member 74 extend a short distance past the outer diameter of the rotation plates. These ends are covered by grips 78 designed to provide handles for the user to facilitate mounting of the exercise device 10.

Positioned between the upper rotatable connections 22 and 24, and attached to both sides of the U-shaped tubular member 74 of the leg restraining member 42, is a substantially horizontal pelvic brace 80. This pelvic brace 80, which has a longitudinal axis co-extensive with the rotational axis of the rotation and lock assemblies 34 and 36 and the leg restraining member 42, is designed to underprop the anterior pelvic area of the body 12 to hold it above the support surface 14. The pelvic brace 80 includes a linear tube 82, attached at both ends to the leg restraining member 42, and an enlarged, generally cylindrical cushion 84 which encircles the linear tube. The cushion 84 is rotatable about the linear tube 82 to ease mounting of the body 12 on the exercise device 10 and to promote proper positioning of the anterior pelvic area over the pelvic brace 80.

Figure 6:
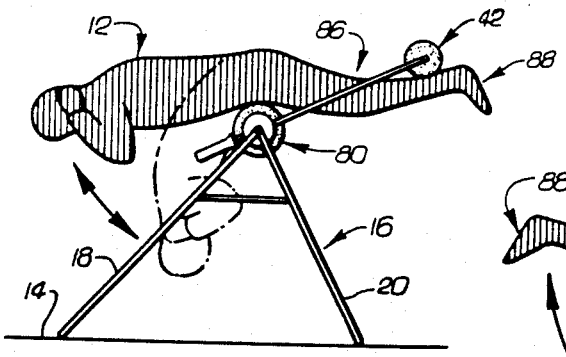
FIG. 6 is a side elevational view of the exercise device illustrating the manner a person would mount and use the device to stretch and strengthen the back extensor muscles while simultaneously decompressing the spinal column.

To utilize the exercise device 10 to stretch and strengthen substantially all of the back extensor and abdominal muscles, the leg restraining member 42 is positioned with respect to the pelvic brace 80 to provide a generally downwardly directed force to the backs of a user's legs 86 (FIG. 1). The user mounts the device 10 by first standing between the pelvic brace 80 and the leg restraining pad 76, facing the pelvic brace with the anterior pelvic area touching the pelvic brace. While keeping the body 12 generally straight and using the grips 78 as handles, the user leans over the pelvic brace 80 and simultaneously lifts his or her feet 88 off of the support surface 14. The body 12 rotates about the pelvic brace 80 until the backs of the legs 86 contact the leg restraining pad 76, at which time the straightened body will be cantilevered with the upper portion thereof unsupported (FIG. 6). Having the exercise device 10 so positioned and the user so mounted with the body 12 generally horizontal and face down, gravity traction can be utilized to decompress the spinal column while the user simultaneously stretches and strengthens substantially all of the back extensor muscles. Additionally, inverted sit-ups can be performed from this position to strengthen and tone the abdominal muscles.

Figure 7:
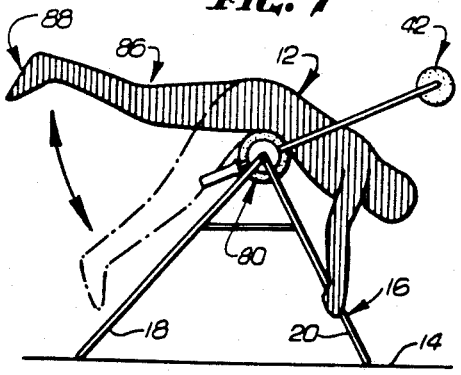
FIG. 7 is a side elevational view of the exercise device illustrating the manner a person would mount and use the device to exercise and tone the gluteus maximus muscles.

Alternatively, as illustrated in FIG. 7, to strengthen and tone the gluteus maximus muscles the user can mount the exercise device 10 by first facing the leg restraining member 42 and positioning the body 12 next to the pelvic brace 80 on the side of the device opposite the leg restraining member. Bending at the waist, the user then leans over the pelvic brace 80 and grasps both sides of one of the frame support legs 20. When so positioned, the user holds the torso portion of the body 12 stationary, with respect to the device 10, and then moves his or her legs 86 in any combination of vertical, horizontal and rotational directions. Important benefits derived from exercising the gluteus maximus muscles as described include spinal column decompression while the user is so mounted and very rapid strengthening and toning of the muscles resulting from regular use of the device 10 in this fashion.

Figure 4:
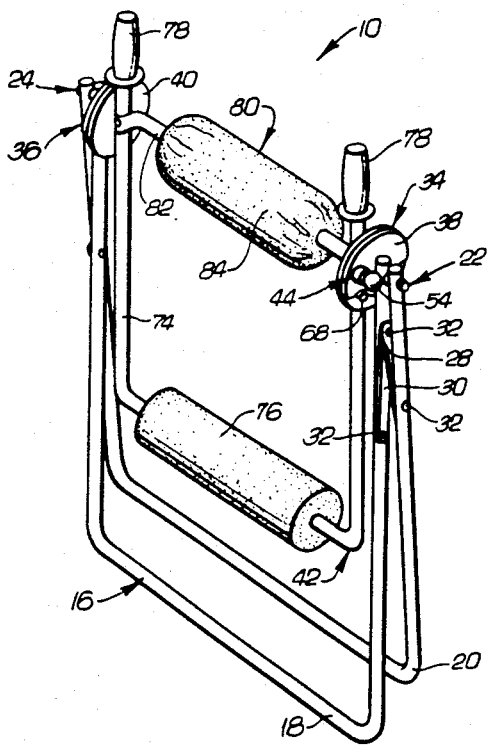
FIG. 4 is a perspective view of the exercise device when completely folded or collapsed.

When the user has finished exercising and desires to store the device 10, it may be conveniently folded to reduce its storage volume and increase its portability (FIGS. 4 and 5). To accomplish this, the ball 54 is grasped and pulled away from the stop plate 38, thereby causing the stop shaft 48 to withdraw from the "use" aperture 62. The rotation plate 40 is then rotated until the leg restraining member 42, and more specifically the cylindrical pad 76, hangs generally below the pelvic brace 80. After the "folding" aperture 64 within the rotation plate 40 is aligned with the stop shaft 48 of the locking mechanism 44, the user releases the ball 54 which allows the spring 60 to cause the stop shaft to extend through the "folding" aperture and lock the leg restraining member 42 in place. The locking bars 28 and 30 are then pulled upwardly, causing them to pivot about their common connecting rivet 32, and the frame support legs 18 and 20 are rotated about their upper rotatable connections 22 and 24 to cause the frame support legs to collapse upon one another. When these simple steps have been taken, the exercise device 10 is in a configuration permitting convenient storage and portability.

From the foregoing, it is apparent that a unique exercise device 10 has been provided including a sturdy frame 16 for supporting a leg restraining member 42 which can be positioned for convenient mounting, use and collapsibility. A locking mechanism 44 prevents the unintended rotation of a rotation plate 40 and insures safe and enjoyable use of the device 10. During use, the leg restraining member 52 is positioned higher than the pelvic brace 80 so that, in one use mode, a user's body 12 is cantilevered thereon and when straightened, the body lies in a horizontal plane suspended above the support surface 14. In this mode, back and abdominal muscle exercises have the effect of decompressing the spine and strengthening and stretching such muscles as previously not possible with other similar devices. In a second use mode, the device 10 can be used to stretch, strengthen and tone the gluteus maximus muscles. With the device 10, very rapid results are possible and, through regular exercising, a user will soon feel more relaxed, healthy and vigorous. Additionally, the benefits, both psychological and physical, resulting from a slimmer and trimmer body 12 make such a device 10 an important addition to almost any lifestyle.

Although a particular embodiment of the invention has been described in detail for purposes of illustration, various modifications may be made without departing from the spirit and scope of the invention. Accordingly, the invention is not to be limited except as by the appended claims.

I claim:

1. A portable collapsible exercise device for suspending the human body above a support surface to decompress the spinal column while exercising the back extensor and abdominal muscles and for strengthening and toning the gluteus maximus muscles, said exercise device comprising:

a pair of U-shaped support members each have two side sections and a middle section, each side section having a free end and a ground end that is connected to said middle section, said middle section contacting the ground while in use;

means for pivotably connecting said support members to each other so that said support members can be moved between a divergent supporting position and a substantially parallel collapsed position;

a pelvic brace for underpropping and supporting the body extending between said free ends of each of said support members;

a U-shaped leg restraining member having two side sections and a middle section, each side section having a free end that includes a handle portion, rotatable about an axis defined by the points of connection of the pair of U-shaped support members between an in-use position in which it extends away from said support members and a storage position alongside said support members, said pelvic brace being supported on the two free ends of the U-shaped leg restraining members at points of attachment adjacent to said handles, said leg restraining member including a leg contact section parallel to said pelvic brace for applying a downwardly directed force to the backs of the user's legs; and locking means for securing said leg restraining member in a selected one of a plurality of positions to facilitate mounting, use and collapsibility of said device.

2. The exercise device of claim 1 further comprising means for releasably holding said support members in said supporting position.

3. The exercise device of claim 1 wherein said leg restraining member extends past said pelvic brace to provide hand gripping portions to aid in mounting said device.

4. The exercise device of claim 1 wherein said locking means includes a stationary plate secured to said frame and a rotatable plate connected to said leg restraining member.

5. The exercise device of claim 4 wherein said locking means further comprises a shaft arranged to interlock said plates to prevent relative movement.

6. The exercise device of claim 4 further comprising a limiting member for limiting movement of said rotatable plate relative to said stationary plate.

7. The exercise device of claim 1 wherein said support members and said leg restraining member are made of tubular steel.

8. The exercise device of claim 1 wherein said pelvic brace and said leg contact section are padded.

9. A portable, collapsible exercise device for suspending the human body above a support surface to decompress the spinal column while exercising the back extensor and abdominal muscles and for stengthening and toning the gluteus maximus muscles, said exercise device comprising;

a pair of U-shaped tubular steel support members, each having two side sections and a middle section, each side section having a free end and a ground end that is connected to said middle section, said middle section contacting the ground while in use;

means for pivotably connecting said support members to each other so that said support members can be moved between a divergent support position and a parallel collapsed position;

a padded pelvic brace for underpropping and supporting the body extending between opposite ends of each of said support members;

a U-shaped tubular steel leg restraining member having two side sections and a middle section, each side section having a free end that includes a handle portion and which projects past said pelvic brace to provide handgripping portions to aid in mounting said device, said leg restraining members being rotatable about an axis defined by the points of connection of the pair of U-shaped support members between an in-use position in which it extends away from said support members and a storage position alongside said support members, said pelvic brace being supported on the two free ends of the U-shaped leg restraining members at points of attachment adjacent to said handles, said leg restraining member including a padded leg contact section parallel to said pelvic brace for applying a downwardly directed force to the backs of the legs of the user;

means for releasably holding said support members in said supporting position;

a stationary plate secured to said support members;

a rotatable plate secured to said leg restraining member; and locking means for preventing relative rotation between said plates and thereby securing said leg restraining member in one of a plurality of selected positions to facilitate mounting, use and collapsibility of said device.

10. The exercise device of claim 9 wherein said locking means comprises an axially movable shaft mounted on one of said plates and insertable in an aperture in the other of said plates.

11. The exercise device of claim 9 wherein one of said plates carries a limiting stub thereon and the other of said plates has two abutment surface thereon that are engageable with said stub to limit relative movement between said leg restraining member and said support members.

12. The exercise device of claim 9 wherein:

said locking means comprises an axially movable shaft mounted on one of said plates and insertable in an aperture in the other of said plates; and one of said plates carries a limiting stub and the other of said plates has two abutment surfaces thereon that are engageable with said stub to limit relative movement between said leg restraining member and said support members.

* * * * *

UNITED STATES PATENT AND TRADEMARK OFFICE

CERTIFICATE OF CORRECTION

PATENT NO. : 4,609,193

DATED : September 2, 1986

INVENTOR(S) : Win S. Paris
Russell Knipp

It is certified that error appears in the above-identified patent and that said Letters Patent is hereby corrected as shown below:

In column 7, line 24 delete "52" and insert therefor -- 42 --.

In column 7, line 53 delete "have and insert therefor -- having --.

Signed and Sealed this

Second Day of December, 1986

*Attest:*

DONALD J. QUIGG

*Attesting Officer*

*Commissioner of Patents and Trademarks*